United States Patent [19]

Sanders et al.

[11] 4,308,915

[45] Jan. 5, 1982

[54] THIN SHEET HEAT EXCHANGER

[76] Inventors: Nicholas A. Sanders, 1022C 27th Ave. SE., Minneapolis, Minn. 55414; Horia A. Dinulescu, 1530 S. 6th St., Minneapolis, Minn. 55454

[21] Appl. No.: 200,927

[22] Filed: Oct. 27, 1980

[51] Int. Cl.[3] ..... F28F 3/10

[52] U.S. Cl. ..... 165/166

[58] Field of Search ..... 165/166, 167

[56] References Cited

U.S. PATENT DOCUMENTS

| | | | |
|---|---|---|---|
| 1,727,124 | 9/1929 | Lonsdale | 165/166 |
| 2,368,814 | 2/1945 | Fagan | 165/166 |
| 2,393,713 | 1/1946 | Shoults | 165/166 |
| 29,59,401 | 11/1960 | Burton | 165/166 |
| 2,961,222 | 11/1960 | Butt | 165/166 |

FOREIGN PATENT DOCUMENTS

| | | | |
|---|---|---|---|
| 692015 | 8/1964 | Canada | 165/166 |
| 2441144 | 6/1980 | France | 165/166 |
| 488571 | of 0000 | United Kingdom | 165/166 |
| 2043865 | 10/1980 | United Kingdom | 165/166 |

OTHER PUBLICATIONS

Crossflow Heat Exchanger, Berger et al., IBM Technical Disclosure Bulletin, vol. 13, No. 10, Mar. 1977, p. 3011.

*Primary Examiner*—Sheldon J. Richter

*Attorney, Agent, or Firm*—Williamson, Bains, Moore & Hansen

[57] ABSTRACT

A thin sheet heat exchanger is provided which facilitates the transfer of heat between two flowing streams of gas. The heat exchanger is formed of a packing of rectangular heat exchange plates positioned by the method of the present invention separately and parallelly to one another. The packing realizes a crossflow channel pattern for the two gas streams. The heat exchange plates which compose the bulk of the heat exchanger are, by the method of the present invention, folded at two opposite sides. The plates are stacked as prescribed by the method of this invention, and seam-weld (or equivalent) sealed along the folded sides of each pair of consecutive plates, thus forming individual gas channels. Also by the method of the present invention gasket sealing surfaces and flange mounting surfaces are realized by the said folds of the said heat exchange plates.

A heat exchanger system can be constituted by a plurality of said heat exchangers assembled, by the method of the invention, to relaize a desired combination of flow patterns.

18 Claims, 6 Drawing Figures

THIN SHEET HEAT EXCHANGER

BACKGROUND OF THE INVENTION

The present invention relates to a plate type gas to gas heat exchanger and more particularly it relates to a plate type heat exchanger having a plurality of thin rectangular plates which is simply constructed and efficient in operation. The invention is particularly suited for but not limited to the exchange of heat between process flue gas and an incoming process gas such as combustion air. As is well known the exchange of heat between a cold stream entering a process and a hot stream leaving a process leads to a reduction in the total energy requirement of the process. Hence, it is common practice on furnaces, incinerators and the like to preheat incoming combustion air, thereby increasing the process efficiency. Heretofore various types of gas to gas heat exchangers have been used in this connection.

A conventional plate type heat exchanger used for heat recovery from gas streams generally consists of a plurality of plates which are made of thick metal material so as to withstand the pressure difference between the two streams and possible corrosion effects. In order to reduce the bulk size of such an exchanger the heat exchange plates are provided with fins which are welded to the plates or formed with the plates by casting. Since finning adds considerable weight to the heat exchange plates these exchangers are heavy and of considerable bulk. In the patent by W. F. Hart, U.S. Pat. No. 4,029,146, an attempt was made to overcome these disadvantages by forming the heat exchange plates out of corrugated thin metal sheets which are mounted in a packing and are pressed together by the pressure difference between the two streams. The corrugation rims on two adjacent plates serve to separate the plates against the pressure difference between the two streams, but in the same time the corrugation rims form narrow channels through which the two fluids must flow. In furnace heat recovery applications, this arrangement presents the disadvantage that the narrow channels can become clogged by soot deposition from the combustion gases thus impairing the proper functioning of the exchanger. The heat exchanger of the present invention overcomes the above mentioned difficulties by attaching to each plate, by rivets, spotwelding, or any other method, a series of reinforcing strips which serve to maintain the separation of the plates against the pressure difference of the two streams, at the same time providing wide channels through which gas can flow. The present invention also prevents a method for the easy realization of a thin plate exchanger by folding the plate sides in such manner as to allow for the sealing of the two streams from each other and to provide external gasket sealing and flange mounting surfaces.

SUMMARY OF THE INVENTION

It is the object of this invention to provide a thin sheet heat exchanger which is simply constructed and efficient in operation.

The heat exchanger according to the present invention consists of one or several packings of rectangular heat exchange plates. Each packing constitutes an assembly of rectangular crossflow channels for the two gas streams. Each of the said packings consists of a plurality of rectangular heat exchange plates. The heat exchange plates are made preferably of thin sheets of some corrosion-resistant material such as stainless steel.

The thickness of the said metal sheet is selected with consideration given to material strength and corrosion resistance and is made as small as possible. A nominal value of the sheet thickness may be 0.5 mm. The heat exchange plates are plane surface rectangles of which two opposite sides are folded to provide a means for the assembly of the plate stacks forming a packing. The heat exchange plates are fixed in a stack by electrical resistance seamwelding or an equivalent procedure. Also by the method of the present invention the folds at the sides of the heat exchange plates are made in such manner as to create in the stack composite external gasket sealing and frame support surfaces.

Positioned between each two consecutive plates, is a multiple of reinforcement strips disposed parallelly to the associated gas flow in the corresponding channel. The reinforcement strips are made preferably of corrosion-resistant material such as stainless steel and serve both to rigidize the plate packing and to provide a means of separating the plates against the pressure difference between the two streams.

A plate packing may be constructed by building two identical stacks of the said heat exchange plates which are then fixed together face to face through an intermediate specially formed mounting box. The thus formed composite constitutes a pattern of rectangular crossflow channels which insures thorough separation of the two gas streams and adequate connectability to the external duct work. The mounting box consists of thin rectangular sheet folded such as to accommodate the attachment of the two identical stacks of heat exchange plates. The mounting box is preferably made of some corrosion-resistant material such as stainless steel, and is affixed to the two plate stacks by electrical resistance welding or the like.

A plate packing may also be constructed by building a single stack of said heat exchange plates and affixing the said mounting box to the last said heat exchange plate.

External gasket sealing surfaces are provided by the method of the invention at each of the four composite channel openings by the folded edges of the heat exchange plates. These same surfaces are used for the mounting and support frames of the heat exchanger. The mounting and support frames consist of four support channels and two end frames. The support channels are preferably made of some corrosion-resistant material such as stainless steel. The external seal between the two flowing gas streams and the duct work is made by the support channels by pressing a sealing gasket on to the surfaces provided by the folded sides of the heat exchange plates. The gasket is preferably a ceramic fiber. The support channels are held in place by the use of specially placed corrosion-resistant tie bolts and tie rods. The end external sealing is made by the two end frames by pressing sealing gaskets on to the surfaces provided by the folded sides of the heat exchange plates. The end frames are held in place by the use of specially placed corrosion-resistant tie bolts and tie rods.

By the use of said tie bolts and tie rods thermal expansion of the said heat exchanger can be accommodated. The heat exchanger as described above can be used singly as a gas to gas crossflow heat exchanger or it can be used as a module in a multi-module gas to gas heat exchange system presenting a crossflow channel pattern or a combination of crossflow and counterflow or any other combination of channel patterns. A heat exchanger is thus achieved which provides good separation of the two gas streams, without mixing of the two gases and free from leaks to the environment. Compared to a conventional gas to gas finned heat exchanger for the same heat transfer duty the thin sheet heat exchanger of the present invention has a small bulk volume, reduced weight and reduced pressure drop. Clogging by soot in the combustion gases does not constitute a problem with the present invention since there are no narrow passages and soot can be removed by appropriately installed soot-blowers. These and other objects of the present invention will become readily apparent as the following description is read in conjunction with the accompanying drawings wherein like reference numerals are used to refer to the different views.

DESCRIPTION OF THE PREFERRED EMBODIMENT

Figure 1:
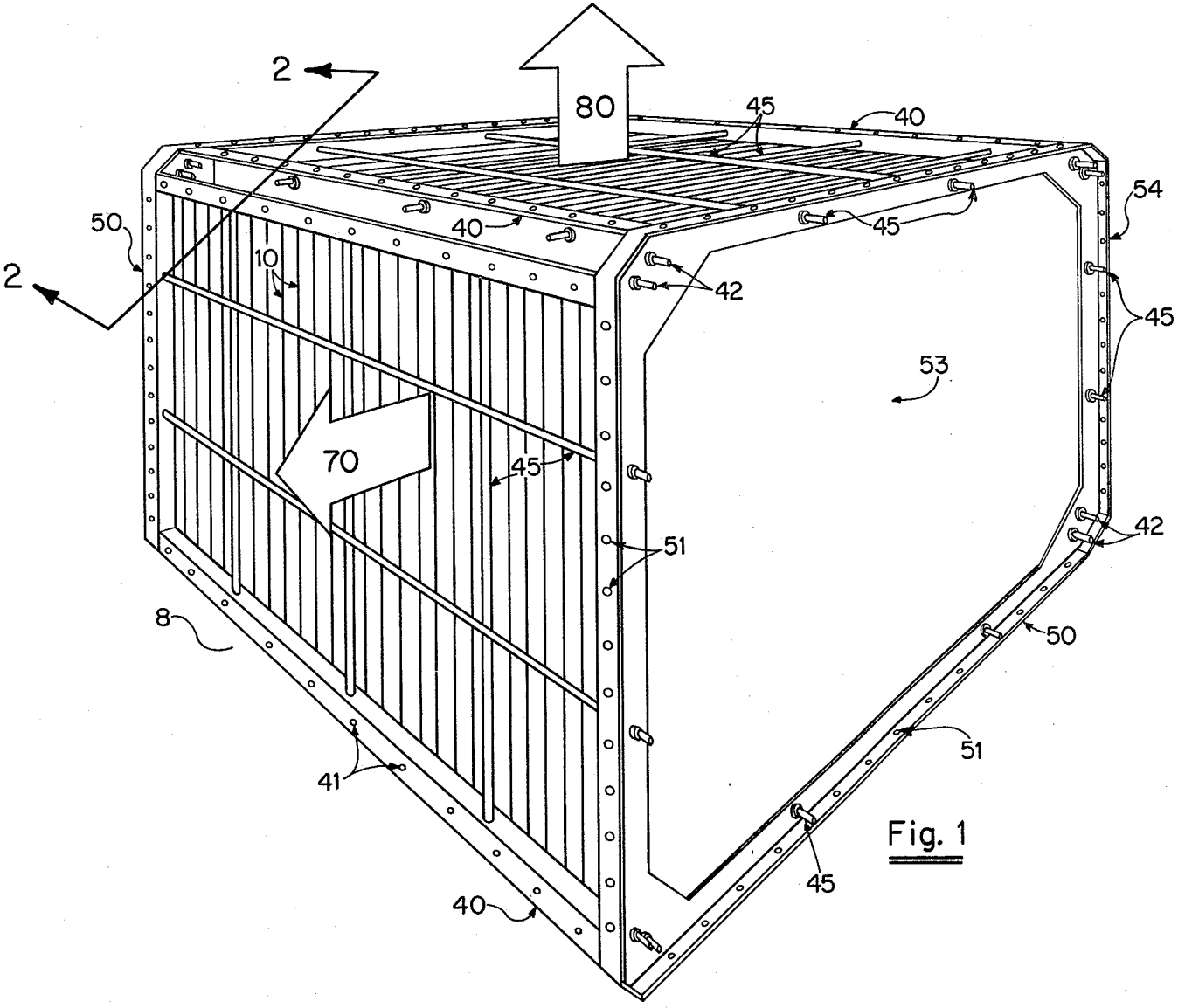
FIG. 1 is a perspective view of the thin sheet heat exchanger comprised, of a single heat exchange plate packing.
Figure 2:
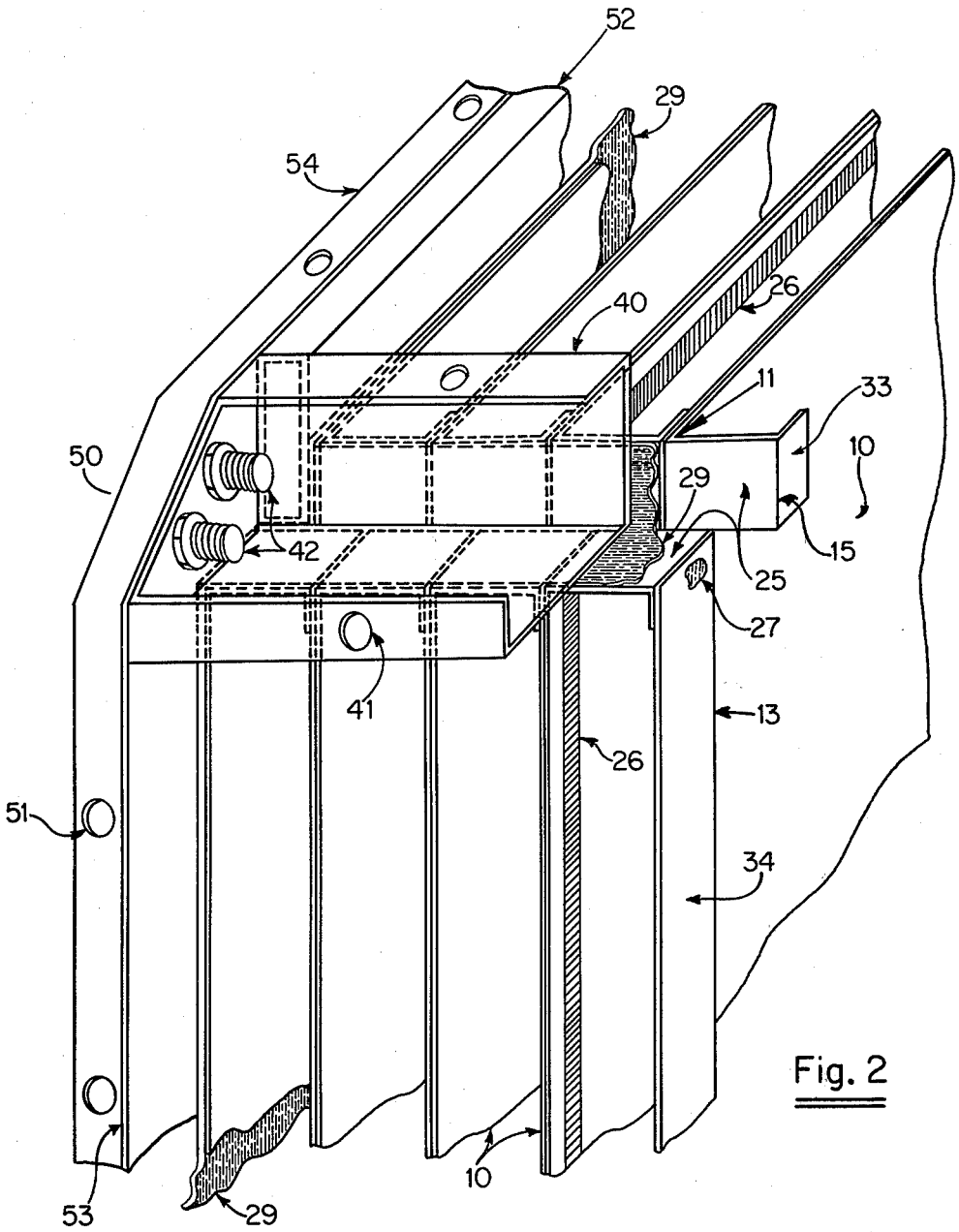
FIG. 2 is an exploded view of the corner 2—2 of FIG. 1.
Figure 3:
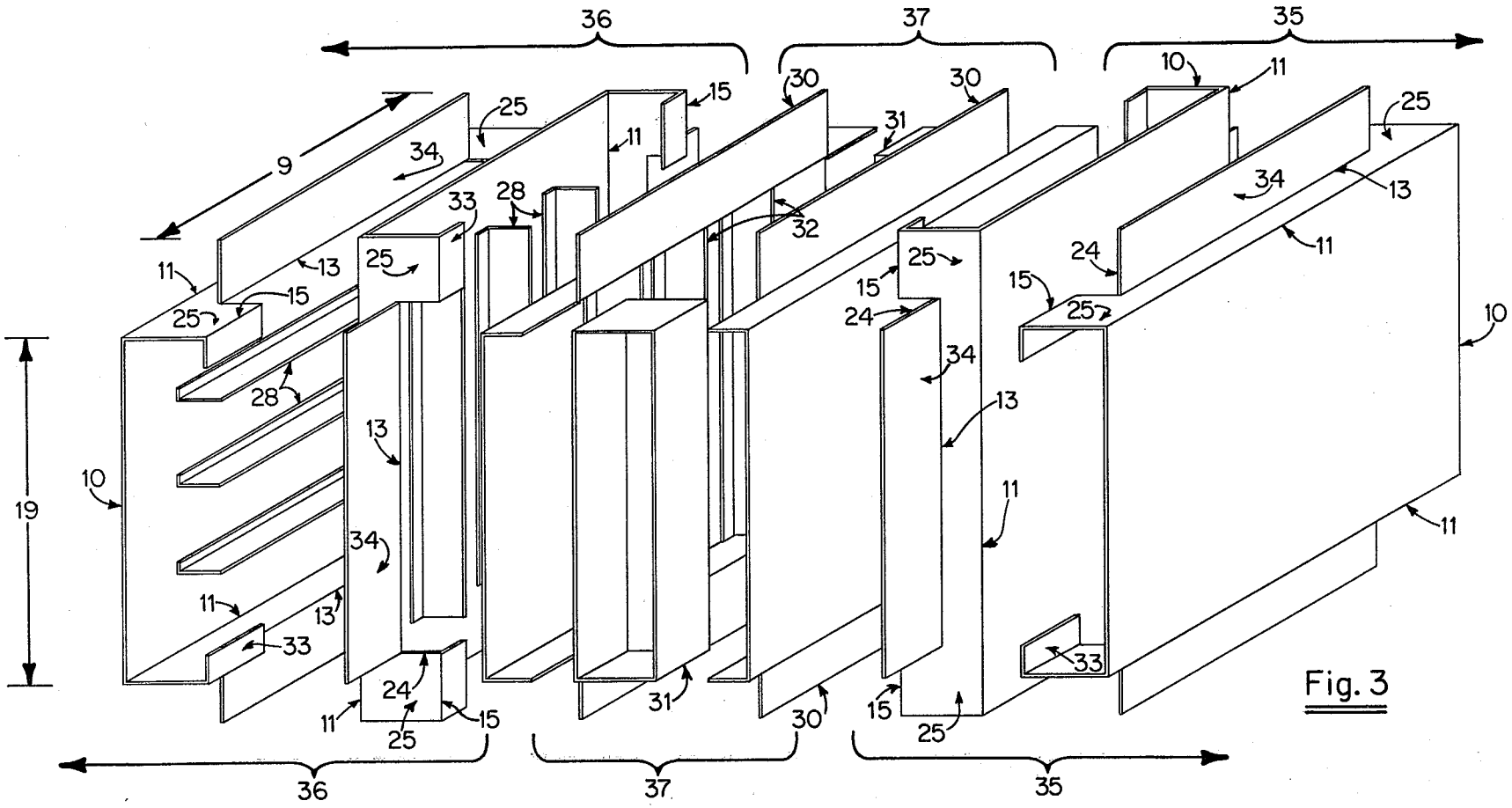
FIG. 3 is a perspective view of the two heat exchange plate stacks together with the center box assembly; altogether forming a complete heat exchange plate packing.
Figure 4:
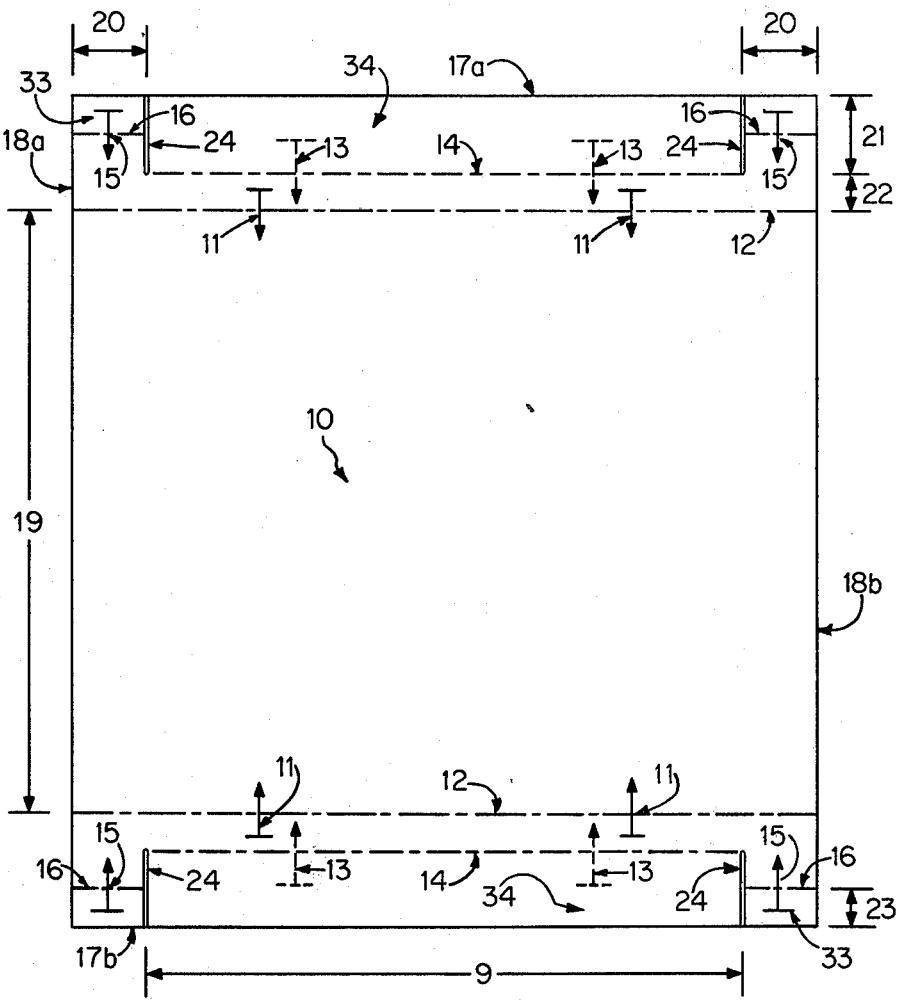
FIG. 4 is a plane view of a heat exchange plate before folding.

The Thin Sheet Heat Exchanger 8 is principally composed of a plurality of heat exchange plates 10 and an enclosing frame which generally comprises end frames 50 and support channels 40.

The heat exchange plates 10 provide the means for the transfer of heat between two streams of flowing gas 70 and 80. Gas streams 70 and 80 are generally at different pressures and flow through the heat exchanger 8 separately and in a crossflow manner. The heat exchange plates 10 are made of thin rectangular metal sheets and have the sides folded so as, when stacked, form a crossflow channel pattern for the passage of the said gas streams 70 and 80. The heat exchange plates are preferably made of corrosion-resistant material such as stainless steel. The thickness of the heat exchange plates 10 is selected with consideration given to material strength and corrosion resistance to be as thin as possible. A nominal value of the said thickness may be 0.5 mm. Prior to folding, the heat exchange plates 10 are cut into a generally rectangular shape with two opposing sides 17*a* and 17*b* and two opposing sides 18*a* and 18*b*. Two cuts 24 are made into each of the sides 17*a* and 17*b* at a distance 20 in from each of the sides 18*a* and 18*b* and to a cut depth of 21. A first 90° forward fold 11 is made along line 12 on both of the sides 17*a* and 17*b*. This is followed by a second 90° backward fold 13 along line 14 on both of the said sides 17*a* and 17*b*. These two folds create a channel with a depth of 22 and a width of 19. The length of the channel is 9 plus the two distances 20. For the case of the preferred embodiment distance 19 is equal to distance 9. Also, for the case of the preferred embodiment a third 90° forward fold 15 is made along lines 16 on both of the said sides 17*a* and 17*b*. This fold is made a distance 23 in from the said sides 17*a* and 17*b*. This last fold 15 allows for a larger sealing surface 25 while supplying an additional weld support surface 33. Although fold 15 is included in the preferred embodiment it can be eliminated.

In general depth 21 is equal to distance 20. Also, depth 21 is equal to the channel depth 22 plus the distance 23. The folded heat exchange plates 10 are in the case of the preferred embodiment identical in shape and form, with folded side 17*a* being the mirror image of folded side 17*b*. By virtue of a constant channel depth 22 and by virtue of having distance 19 equal distance 9 the above method of folding leads, for the preferred embodiment to the realization of square heat exchange plates 10 which are stacked to form a heat exchange plate packing.

It should be noted that although in the preferred embodiment identical square heat exchange plates are used the same method of folding can be applied to form rectangular heat exchange plates where distance 19 is not equal to distance 9 and the channel depth 22 is different for gas streams 70 and 80. This is done by forming two separate sets of rectangular plates, one set being folded as described above on the opposing short sides the other set being folded on the opposing long sides. The channel depth for each set may be different. Once the channel depths 22 are established distances 20 and 21 can be determined so as to allow for a uniform sealing surface 25 when the two sets of plates are alternately stacked to form a heat exchange plate packing.

Each of the said heat exchange plates 10 has in its associated channel a multiple of reinforcement strips 28, affixed to it by electrical resistance spot welding or an equivalent procedure. The strips being disposed so as to run parallel to the gas flow direction. The said reinforcement strips 28 serve generally to rigidize the composite structure and maintain the corresponding channel depth against the pressure difference of the two gas streams.

Folded heat exchange plates 10 are stacked into two identical composite assemblies 35 and 36. Since for the preferred embodiment the channel width 19 equals the channel length 9 and the channel depth 22 is the same for all said plates 10, by rotating every other plate 90° the plates are combined into composite assemblies with alternate channels being turned 90° from each other. The heat exchange plates 10 are fixed at their folded sides into a composite assembly by continuous electrical resistance seamwelding 26 or an equivalent procedure along surfaces 34. Also for the preferred embodiment surfaces 33 are spotwelded 27 (or equivalent) into the composite assembly. The said composite assemblies 35 and 36, each consisting of a plurality of heat exchange plates 10 are fixed into a single heat exchange plate packing by the use of the mounting box assembly 37. The mounting box assembly 37 consists of two identical mounting plates 30 and two identical mounting cups 31. The mounting plates 30 are fixed together face to face by seamwelding or the like. Cups 31 are welded into plates 30 making the mounting box assembly 37 a simple solid assembly. In addition, reinforcement strips 32 are fixed by seamwelding or the like to the interior of the mounting box assembly 37. The said strips 32 serve to rigidize and support assembly 37. Parts 30, 31 and 32 are preferably made of some corrosion-resistant material such as stainless steel.

Although in the preferred embodiment two stacks of heat exchange plates are joined together by a mounting box assembly to form a plate packing. A plate packing could also be formed of a single stack of heat exchange plates with a mounting box affixed to the terminating end.

The thus constructed heat exchange plate packing is a composite of crossflow channels with an external gasket sealing surface 25 intrinsically provided by the previously described method of folding the sides of the said heat exchange plates 10. The sealing is then accomplished by the use of a ceramic fiber gasket 29 or other adequate gasket material.

The composite assembly which consists of assemblies 35, 36 and 37 is held in the enclosing frame which consists of end frames 50 and support channels 40 by the use of tie bolts 42 and tie rods 45. This total assembly constitutes a complete heat exchange plate packing plus framework which may be used singly as a cross flow heat exchanger or may be used as a module in a multi-module heat exchange system. The end frame 50 further consists of sealing channels 52, end plate 53 and frame 54 with duct bolt holes 51. The support channels 40 also have duct bolt holes 41 included along their length.

Gasket material 29 is placed along the inside of the end frame 50 and along the gasket sealing surfaces 25. Tension is placed on the gaskets by the tie bolts 42 and the tie rods 45.

Figure 5:
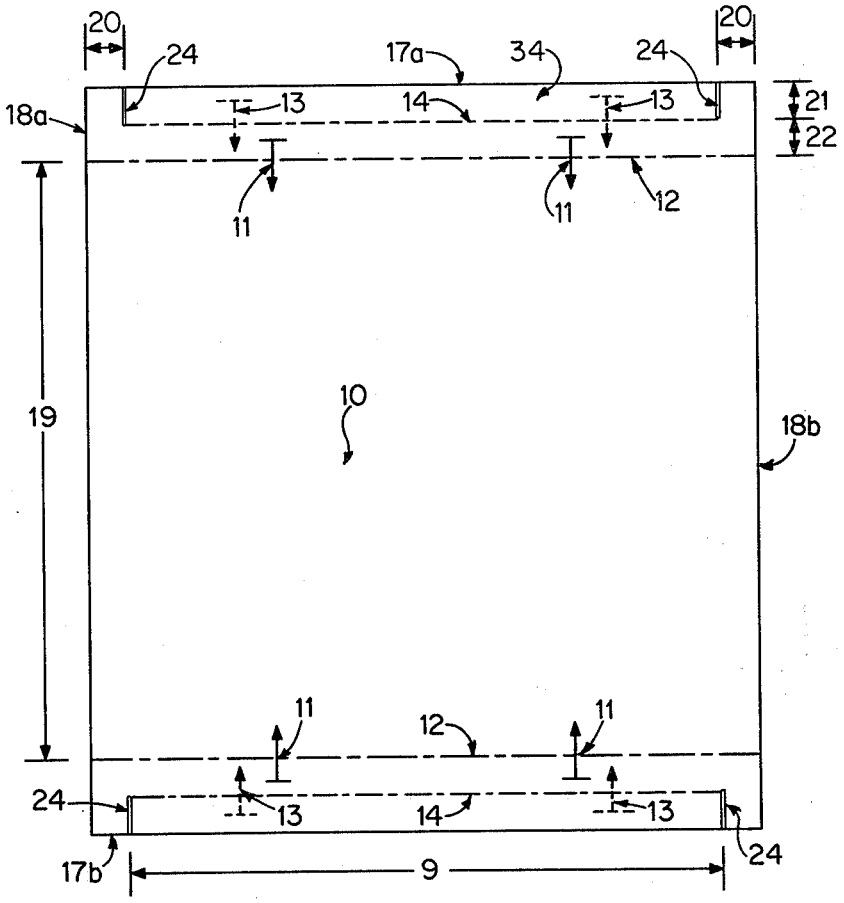
FIG. 5 is a plan view of a modification of a heat exchange plate.

FIG. 5 shows a modification to the heat exchange plate 10 wherein the third fold 15 is eliminated.

Figure 6:
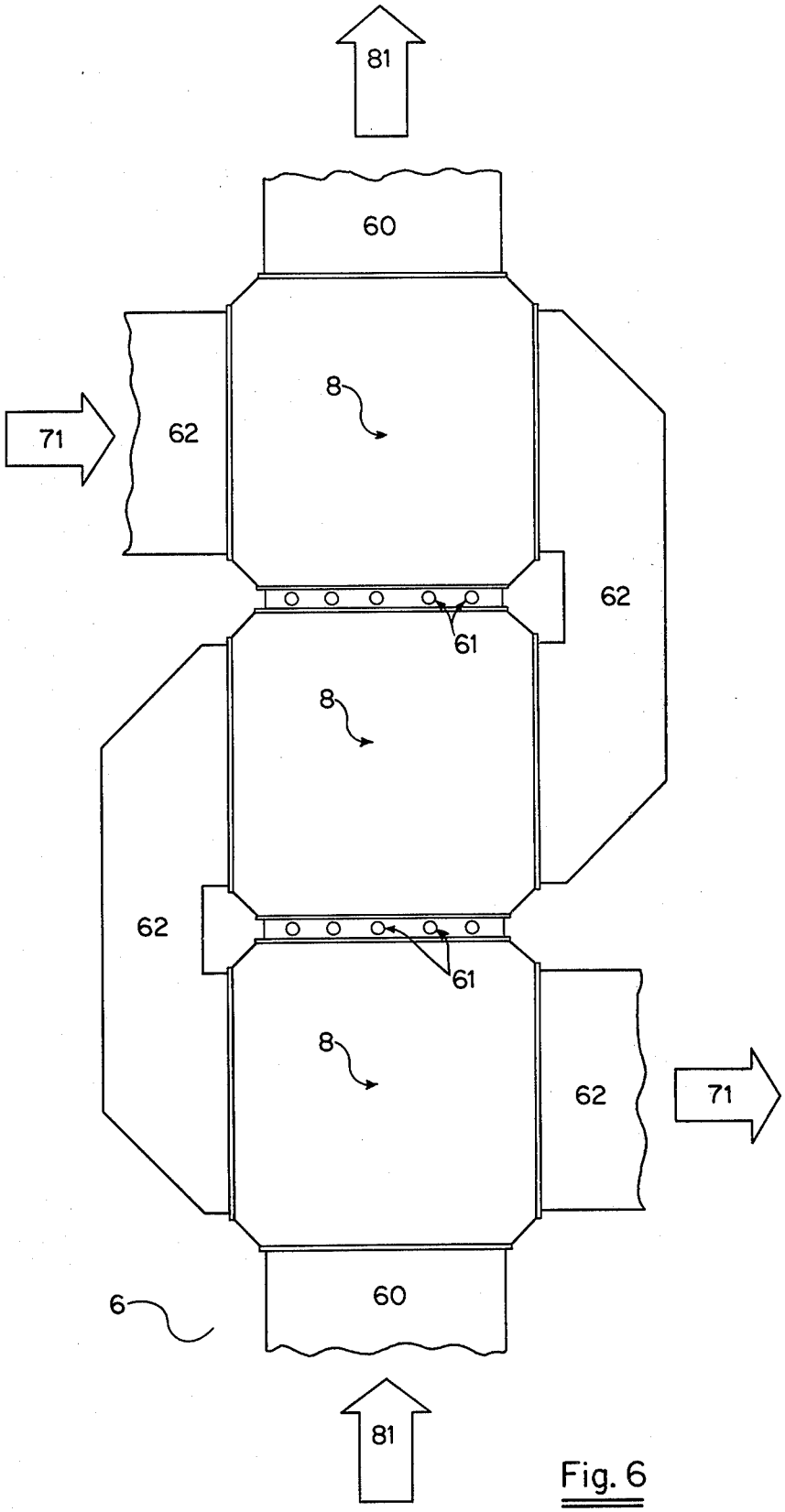
FIG. 6 shows a possible crossflow-counterflow heat exchange system using a multiple of thin sheet heat exchangers.

FIG. 6 shows the thin sheet heat exchanger 8 being used as a single module in a multi-module heat exchange system 6. Process flue gas 81 flows through the heat exchangers 8 in a series manner, entering and leaving through duct work 60. Air 71 passes back and forth through the heat exchangers 8 flowing in a crossflow-counterflow manner with respect to the process flue gas 81. The air enters and leaves through the duct work 62. Also included between the thin sheet heat exchanger units 8, on the flue gas side are conventional soot-blowers 61.

It is contemplated that various changes and modifications can be made to the thin sheet heat exchanger of the current preferred embodiment without departure from the spirit and scope of the invention as defined by the following claims.

We claim:

1. A heat exchange plate for use in a heat exchanger, said heat exchange plate being a plane surface rectangle having a pair of opposing sides folded so as to form by the said heat exchange plate sealing surfaces and a fluid flow channel, each said folded side being formed of a first and second cut and a first and second fold, said first fold being a forward approximately 90° fold and being parallel to the edge of the said fold side and extending the breadth of the said heat exchange plate, said second fold being a backward approximately 90° fold and being parallel to the said first fold and extending between said first and second cuts.

2. The heat exchange plate of claim 1 wherein said heat exchange plate is made of a thin sheet of corrosion-resistant material.

3. The heat exchange plate of claim 1 wherein said heat exchange plate is made of a thin sheet of stainless steel.

4. The heat exchange plate of claim 1 further comprising a third fold wherein said third fold is a forward approximately 90° fold and is parallel to said first fold and extends from said first cut to the adjacent unfolded side of said heat exchange plate and from said second cut to the adjacent unfolded side of said heat exchange plate.

5. The heat exchange plate of claim 1 wherein said heat exchange plate is corrugated.

6. The heat exchange plate of claim 1 wherein said heat exchange plate has reinforcement strips securedly attached to it.

7. A heat exchanger comprising, in combination:

an enclosing frame, said enclosing frame having an inlet and outlet for a first fluid and an inlet and outlet for a second fluid, said enclosing frame being connectable to outside duct work, a heat exchange plate packing, said heat exchange plate packing being comprised of at least one stack of heat exchange plates and at least one means for terminating said stack, each said stack of heat exchange plates being comprised of a plurality of about 90° alternately disposed heat exchange plates, each said heat exchange plate being a plane surface rectangle having a pair of opposing sides folded so as to form by each said heat exchange plate gasket sealing surfaces and a fluid flow channel, said gasket sealing surfaces being exposed to said enclosing frame, each said folded side of each said heat exchange plate being formed of a first and second cut and a first and second fold, said first fold being a forward approximately 90° fold and being parallel to the edge of the said folded side and extending the breadth of the said heat exchange plate, said second fold being a backward approximately 90° fold and being parallel to the said first fold and extending between said first and second cuts, each said heat exchange plate containing in its said fluid flow channel a plurality of reinforcement strips, each said heat exchange plate having said opposing folded sides sealingly joined to the said opposing unfolded sides of the next alternately disposed heat exchange plate in a stack of heat exchange plates, a sealing gasket, said sealing gasket being positioned between and securedly held by the said gasket sealing surfaces and the said enclosing frame, a means to sealingly join said heat exchange plate to the next said alternately disposed heat exchange plate in a stack of heat exchange plates, a means to attach said reinforcement strips to said heat exchange plates, a means to sealingly join said at least one stack of heat exchange plates to said terminating means, a means to securedly attach said enclosing frame to said heat exchange plate packing.

8. The heat exchanger of claim 1 wherein said means to securedly attach said enclosing frame to said heat exchange plate packing comprises tie bolts and tie rods.

9. The heat exchanger of claim 8 wherein said tie bolts and tie rods are comprises of stainless steel.

10. The heat exchanger of claim 7 wherein said enclosing frame is comprised of two end walls and four support channels.

11. The heat exchanger of claim 7 wherein said heat exchange plates are made of thin sheets of corrosion-resistant material.

12. The heat exchanger of claim 7 wherein said heat exchange plates are comprised of thin sheets of stainless steel.

13. The heat exchanger of claim 7 wherein said means for terminating is made of corrosion-resistant material.

14. The heat exchanger of claim 7 further comprising a third fold wherein said third fold is a forward approximately 90° fold and is parallel to said first fold and extends from said first cut to the adjacent unfolded side of said heat exchange plate and from said second cut to the adjacent unfolded side of said heat exchange plate.

15. The heat exchanger of claim 1 wherein said means to sealingly join comprises electrical resistance seam welding.

16. A heat exchange system comprising in combination, at least one heat exchanger, said heat exchanger comprising, in combination:

an enclosing frame, said enclosing frame having an inlet and outlet for a first fluid and an inlet and outlet for a second fluid, said enclosing frame being connectable to outside duct work, a heat exchange plate packing, said heat exchange plate packing being comprised of at least one stack of heat exchange plates and at least one means for terminating said stack, each said stack of heat exchange plates being comprised of a plurality of about 90° alternately disposed heat exchange plates, each said heat exchange plate being a plane surface rectangle having a pair of opposing sides folded so as to form by each said heat exchange plate gasket sealing surfaces and a fluid flow channel, said gasket sealing surfaces being exposed to said enclosing frame, each said folded side of each said heat exchange plate being formed of a first and second cut and a first and second fold, said first fold being a forward approximately 90° fold and being parallel to the edge of the said folded side and extending the breadth of the said heat exchange plate, said second fold being a backward approximately 90° fold and being parallel to the said first fold and extending between said first and second cuts, each said heat exchange plate containing in its said fluid flow channel a plurality of reinforcement strips, each said heat exchange plate having said opposing folded sides sealingly joined to the said opposing unfolded sides of the next alternately disposed heat exchanger plate in a stack of heat exchange plates, a sealing gasket, said sealing gasket being positioned between and securedly held by the said gasket sealing surfaces and the said enclosing frame, a means to sealingly join said heat exchange plate to the next said alternately disposed heat exchange plate in a stack of heat exchange plates, a means to attach said reinforcement strips to said heat exchange plates, a means to sealingly join said at least one stack of heat exchange plates to said terminating means, a means to securedly attach said enclosing frame to said heat exchange plate packing.

17. The heat exchanger of claim 7 or 16 wherein said plurality of reinforcement strips form a unit grid.

18. The heat exchanger of claim 7 or 16 wherein said means for sealingly joining comprises securedly pressing together said alternately disposed heat exchange plates with said enclosing frame.

* * * * *